US006288482B1

(12) United States Patent
Watanabe et al.

(10) Patent No.: US 6,288,482 B1
(45) Date of Patent: Sep. 11, 2001

(54) COLOR CATHODE RAY TUBE WITH REDUCED DRIVE VOLTAGE

(75) Inventors: Kenichi Watanabe, Ohtaki-machi; Syoji Shirai; Shinichi Kato, both of Mobara, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/323,699

(22) Filed: Jun. 1, 1999

(30) Foreign Application Priority Data

Jun. 3, 1998 (JP) ..... 10-154469

(51) Int. Cl.[7] ..... H01J 29/50; H01J 29/58; G09G 1/04

(52) U.S. Cl. ..... 313/414; 315/382; 315/382.1

(58) Field of Search ..... 313/414, 413, 313/412, 449, 439; 315/382, 382.1

(56) References Cited

U.S. PATENT DOCUMENTS

| | | | | |
|---|---|---|---|---|
| 5,034,654 | * | 7/1991 | Leyland et al. | 313/449 |
| 5,077,498 | | 12/1991 | Odenthal | 315/15 |
| 5,221,875 | | 6/1993 | Odenthal | 315/14 |

FOREIGN PATENT DOCUMENTS

| | | |
|---|---|---|
| 53-18866 | 2/1978 | (JP) . |
| 63-250040 | 10/1988 | (JP) . |
| 4-75236 | 3/1992 | (JP) . |
| 5-275026 | 10/1993 | (JP) . |
| 7-94116 | 4/1995 | (JP) . |
| 9-320484 | 12/1997 | (JP) . |

* cited by examiner

*Primary Examiner*—Vip Patel
(74) *Attorney, Agent, or Firm*—Mattingly, Stanger & Malur, P.C.

(57) ABSTRACT

A color cathode-ray tube has a fluorescent body film having picture elements of three colors. A shadow mask provided for the color cathode-ray tube is a color selection electrode and is installed close to the fluorescent face. An electron gun includes a cathode, a first electrode and a second electrode for discharging three electron beams in parallel and in a common plane. Further, the electron gun includes the main lens, which contains several electrodes that focus the three electron beams on the fluorescent face. The average diameter D of the vertical and the horizontal dimensions of the electron beam pass hole in the first electrode, the first electrode thickness T, and the space B between the electron beam pass hole in the first electrode and the electron beam pass hole in the second electrode are defined in an area that is surrounded by four straight lines that are expressed by the following relations, where $A=D^3/T$: 100A=154B+17, 1000A=1420B+17, A=0.6, B=0.08.

23 Claims, 6 Drawing Sheets

COLOR CATHODE RAY TUBE WITH REDUCED DRIVE VOLTAGE

BACKGROUND OF THE INVENTION

The present invention is concerned with the color cathode-ray tube. Especially, the present invention relates to the color cathode-ray tube with the electron gun that discharges 3 electron beams at parallel in the common plane in the direction of the fluorescent face.

The color cathode-ray tube is used for television and for the monitor of the information terminal.

The color cathode-ray tube includes the following components.

(1) Electron gun at which several (3 usual) electron beams are discharged that is provided in the inside of one end of the vacuum envelope (2) Fluorescent face where several (ordinary 3 colors) fluorescent body picture elements were arranged like the mosaic applied to the inside of the other end of the vacuum envelope (3) Shadow mask that is the color selection electrode that stood and installed close to the fluorescent face (4) Deflection yoke installed in the outside of the above vacuum envelope to deflect several electron beams discharged from the above electron gun By scanning the electron beam to two dimensions by the magnetic field that is generated in the deflection yoke, the color cathode-ray tube displays the required image.

FIG. 3 is a perpendicular section that explains outline structure diagram of the color cathode-ray tube.

The color cathode-ray tube has the following components:

panel 1, funnel 2, neck 3, fluorescent body film 4, internal conduction film 5, shadow mask 6, mask frame 6A, mask suspension mechanism 6B, getter 7 and magnetic shield 8.

In addition, the color cathode-ray tube has the following components:

deflection yoke 9, magnet 10 for the adjustment of color purity and the convergence, electron gun 11 of the in-line type, reinforcement metal fitting 12 and stem pin 13.

FIG. 4 is the schematic cross-sectional view that explains the structure of the electron gun of the in-line type that is used for the color cathode-ray tube of this seed. The electron gun shown in FIG. 4 has heater 20, cathode 21, the first electrode 22, the second electrode 23, the third electrode 24, the fourth electrode 25 of the anode, shield cup 26 and contact spring 27, 28 is the thing point (cross OVER). The same code as FIG. 3 corresponds to the same part.

FIG. 5 is the schematic cross-sectional view that explains the structure of the electron beam generation part of the electron gun shown in FIG. 4. The electron beam generation part shown in FIG. 5 has electron beam pass hole 22A of the first electrode 22, electron beam pass hole 23A of the second electrode 23 and electron beam pass hole 24A of the third electrode 24. 30 is the drive circuit. The same code as FIG. 4 corresponds to the same part.

The electron gun of the in-line type mounted in neck 3 in the same diagram discharges 3 electron beams EB (center beam EBc and side beam EBs×2) on the common plane (horizontal face). The intensity of this electron beam is modulated according to the image signal (red Sr, green Sg and blue Sb) that is applied from drive circuit 30 of the outside through stem pin 13. And then, the electron beam is deflected by the deflection magnetic field of the horizontal direction and the vertical direction that are generated in deflection yoke 9. And then, the electron beam is two-dimensionally scanned on fluorescent body film 4, and the image is regenerated.

The electron emitted from cathode 21 heated by heater 20 by 400~1000 V positive electric potential applied to the second electrode 23 in FIG. 4 and FIG. 5 is accelerated to the first electrode 22 side, and 3 electron beams are formed. And then, these 3 electron beams pass electron beam pass hole 22A of the first electrode 22 and pass electron beam pass hole 23A of the second electrode 23. The high voltage of 5–10 kV is applied to the third electrode 24. And then, 3 electron beams receive the focusing action a little through the pre-focus lens that is formed between the second electrode 23 and the third electrode 24. The high voltage of 20–35 kV is applied to the fourth electrode (anode) 25. And then, accelerating by the third electrode 24, 3 electron beams inject into the main lens that is formed between the third electrode 24 and the fourth electrode (anode) 25.

The electrostatic field is formed out of the electric potential difference between the third electrode 24 and the fourth electrode 25 that compose the main lens of this place. Therefore, the above electrostatic field changes the orbit of 3 electron beams EB supplied to the main lens. Therefore, 3 electron beams adjust the focus on fluorescent body film 4 respectively and form the beam spot.

By the magnetic field that is generated in deflection yoke 9 installed in the transition area of funnel 2 and neck 3 of the color cathode-ray tube, this beam spot is two-dimensionally scanned on the whole screen that is composed of the fluorescent body film. And, this beam spot is sorted for each color in the hole opening of shadow mask 6. And then, this beam spot reaches the fluorescent body of the corresponding color, and the required color image is formed.

And, in the actual operation of the color cathode-ray tube like above, the specified voltage is applied to above each electrode. It is simultaneously necessary to control the chromaticity and the brightness of the screen to display the image. By changing the drive voltage that is applied to the cathode that corresponded to each of the fluorescent body of 3 colors as it was shown in FIG. 4, the quantity of the electron beam that is emitted from each cathode is controlled synchronizing with the deflection. And, the cathodic voltage just before emitting the electron beam from the cathode is called the cathodic cutoff voltage. That is, as for this, the brightness of the screen is the voltage as of 0 levels (dark state).

In the cathode-ray tube that is generally used for color television, the diameter of the electron beam pass hole of the first electrode of the electron gun is an ordinary about 0.6 mm. And, in the cathode-ray tube that is used for the display monitor for information processing terminals such as the computer, the drive voltage is almost 50 V. And then, the electric current quantity that is emitted from the cathode at this time is an about 0.3 mA. This is equivalent to the electric current value when the screen of the above cathoderay tube is shown in recommendation brightness. This recommendation brightness is almost 100 cd/m$^2$.

And, about the prior art of this seed, it is disclosed to the Japanese patent publication No. 53-18866 official gazette.

It is most important that in the display image of the color cathode-ray tube like above, brightness, resolution and the contrast are high. Therefore, the reduction of the beam spot diameter in the high brightness is requested, in the cathode-ray tube for the display monitor for information processing terminals such as computer from which these characteristics are required especially. And, high resolution of the fluorescent body dot pitch of each color that constitutes the fluorescent body film is required, and the increase of the number of display picture elements by expansion of the display screen is requested further.

The reduction of the diameter of the thing point that is projected and the increase of the electric current density in the cathode are valid by reducing the measure of the electron beam pass hole of the first electrode and the circumference electrode to reduce the beam spot diameter.

But generally, by the rise of Joule heat, the increase of the cathodic electric current density accelerates evaporation of electron emission materials such as the barium that constitutes the relevant cathode. Therefore, following the declination of cathodic ability, the life of the cathode-ray tube shortens it.

In addition, high resolution of the fluorescent body dot pitch and the increase of the number of display picture elements by screen expansion are connected with reduction of the beam transmission rate of the shadow mask. Therefore, the electric current quantity that is emitted from the cathode to keep screen brightness increases, and the above life shortening is accelerated more. And, it is necessary to heighten the frequency of the drive voltage that the image signal that is applied to the cathode is amplified for the increase of the number of display picture elements. This drive voltage modulates amplitude. It is normally necessary to make the clock frequency of the video band 150–200 MHz to indicate the number of picture elements of 1.3MPixel (correspondence of the 1280 dot×1024 line) –2MPixel (correspondence of the 1600 dot×1200 line). But there is a limit in the frequency characteristics of the circuit to make the amplitude of the image signal an amplification to the drive voltage.

FIG. 6A, FIG. 6B and FIG. 6C are the explanation figures of the answer characteristics of the cathodic drive voltage. The upper limit of the amplitude of the drive voltage to secure screen brightness in the video band of clock frequencies 150–200 MHz as it was shown in FIG. 6A is almost 50 V. As it was shown in FIG. 6B, delay arises in the time of the rise and the fall of the signal in 150 MHz. As it was shown in FIG. 6C,: delay arises in the time of the rise and the fall of the signal in 200 MHz, and the loss of amplitude occurs, and the input signal is deteriorated.

Therefore, the input signal is not accurately communicated to the cathode, and the reduction effect of beam spot does not appear as resolution.

That is, the indication of the vertical line that receives the influence of the horizontal deflection frequency that is relatively high frequency directly becomes difficult. That is, the phenomenon that the brightness declination of the vertical line and the bright line flow in the scanning direction occurs.

On the other hand, the drive voltage is secured about the side line that receives the influence of the vertical deflection frequency that is relatively low frequency directly. As a result the brightness difference of the vertical line and the side line increases, and the image becomes unnatural.

By low setting the cathodic voltage (that is, cathodic cutoff voltage) in the point of time when the electron begins to come out from the cathode from the drive characteristics in the cathode-ray tube, it is known that the amplitude of the drive voltage is reduced. But the beam spot diameter on the screen enlarges, and resolution is deteriorated so that in this case, the electric current density in the cathode decreases simultaneously.

SUMMARY OF THE INVENTION

It is necessary to reduce the drive voltage in the electron gun of the in-line type of the above color cathode-ray tube and to prevent the input signal in the high video band (200 MHZ or more) from deteriorating, and focus characteristics at the time must be prevented from deteriorating.

The purpose of this invention is to dissolve the problem of the above conventional technique. It is to reduce the drive voltage in the color cathode-ray tube. And then, it is the provision of the color cathode-ray tube with the electron gun that can display the image that is high resolution in the high frequency area.

To achieve the above purpose, the present invention provides the following color cathode-ray tubes. The fluorescent face provided for the color cathode-ray tube of the present invention has the fluorescent body film that the fluorescent body picture elements of 3 colors was arranged. The shadow mask provided for the color cathode-ray tube of the present invention is the color selection electrode that stood and installed close to the fluorescent face. The electron gun provided for the color cathode-ray tube of the present invention has the means of generating the electron beam and the means of forming the main lens. The means of generating the above electron beam contains the cathode, the first electrode and the second electrode to discharge 3 electron beams at parallel in the common plane in the direction of the fluorescent face. The means of forming the above main lens contains several electrodes that focus the above 3 electron beams in the fluorescent face. The average diameter of the direction of the vertical and the horizontal of the electron beam pass hole in the above first electrode is made D. The electrode thickness of sheet of the electron beam pass part in the above first electrode is made t.

The space between the electron beam pass hole in the above first electrode and the electron beam pass hole in the above second electrode is made B. Above D, t and B is set in the area that is surrounded in 4 straight lines that are expressed in the following relation.

A is made $D^3/t$ here.

$$100A=154B+17$$

$$1000A=1420B+17$$

$$A=0.6$$

$$B=0.08$$

By this structure, the drive voltage is reduced, the input signal in the high video band (200 MHz or more) is prevented from deteriorating, and focus characteristics at the time are prevented from deteriorating.

DESCRIPTION OF THE PREFERRED EMBODIMENTS

As follows, about the form of performance of this invention, the execution example is referred to and is in detail explained.

As an important element to maintain the focus characteristics of the cathode-ray tube, it has the cathodic electric current density and the thing point diameter. When the electric current quantity is constant, in case of the following, the cathodic electric current density increases.

(1) In case the second electrode electric potential becomes high (2) In case the distance between the cathode and the first electrode becomes near (3) In case the electron beam pass hole of the first electrode becomes small (4) In case the distance between the first electrode and the second electrode becomes near When these relations are acquired, the cathodic electric current density becomes high, and the beam spot diameter on the screen can be made small.

Figure 4:
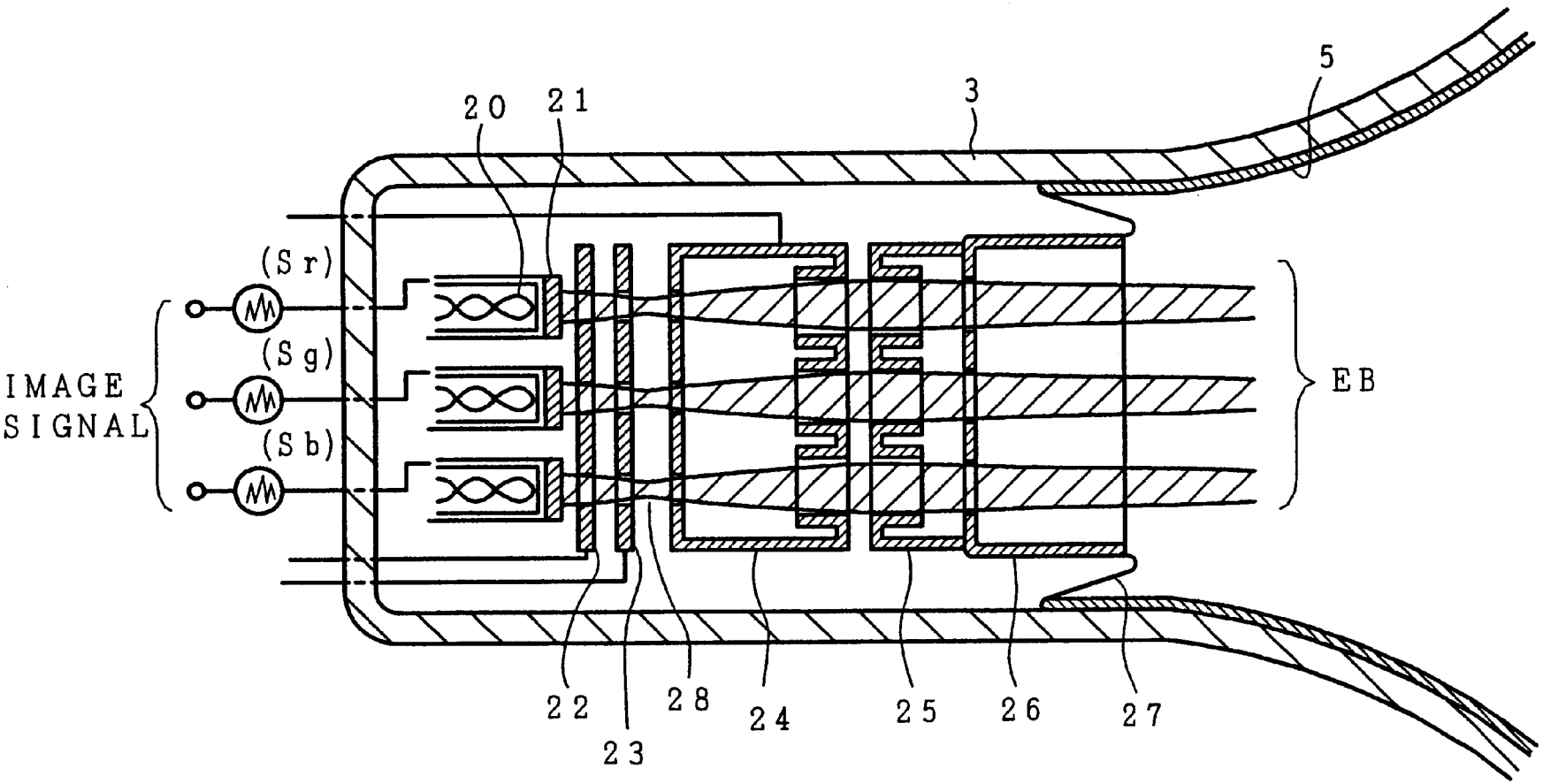
FIG. 4 is the schematic cross-sectional view that explains the structure of the electron gun of the in-line type that is used for the color cathode-ray tube.
Figure 5:
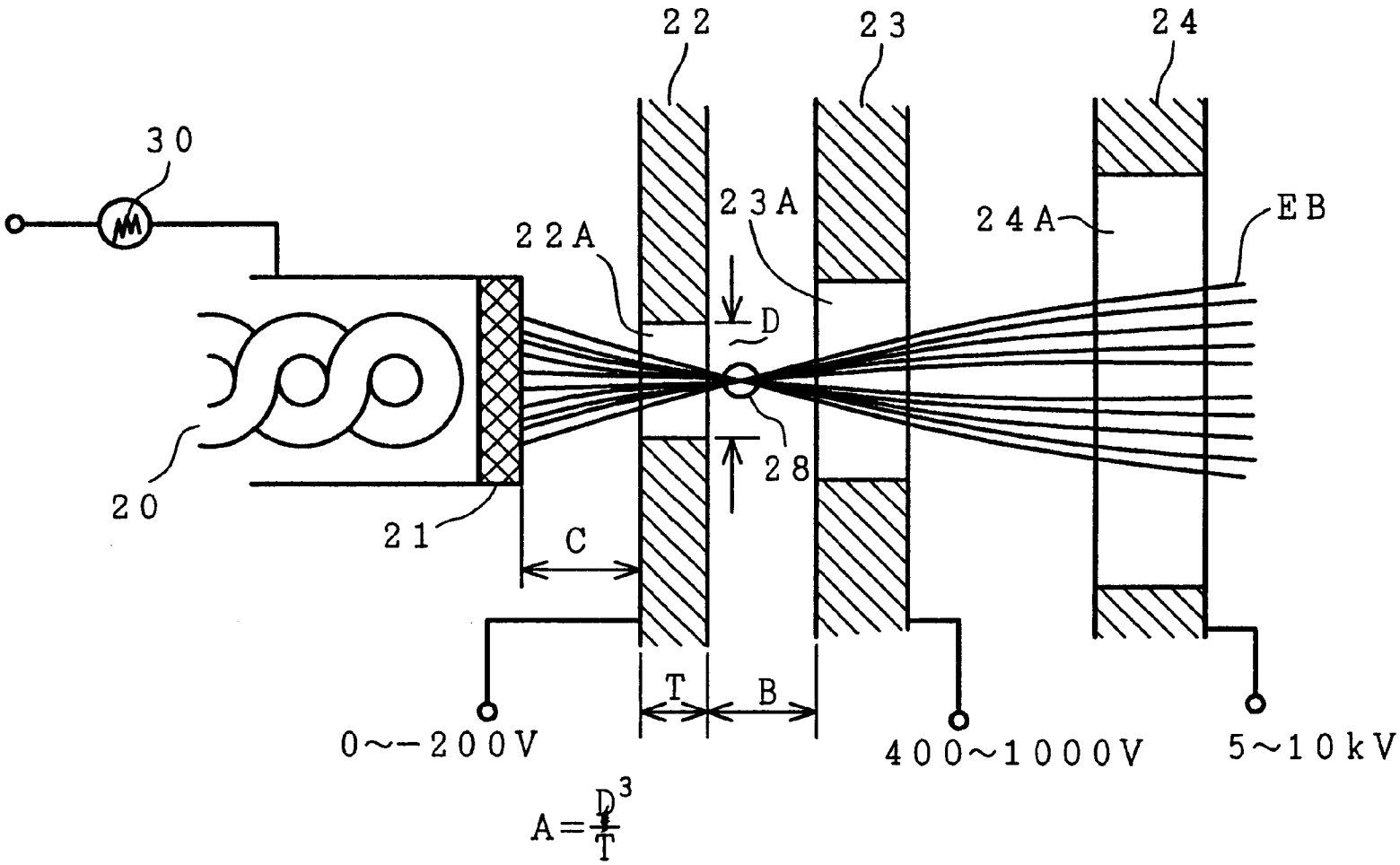
FIG. 5 is the schematic cross-sectional view that explains the structure of the electron beam generation part of the electron gun shown in FIG. 4.
Figure 6A:
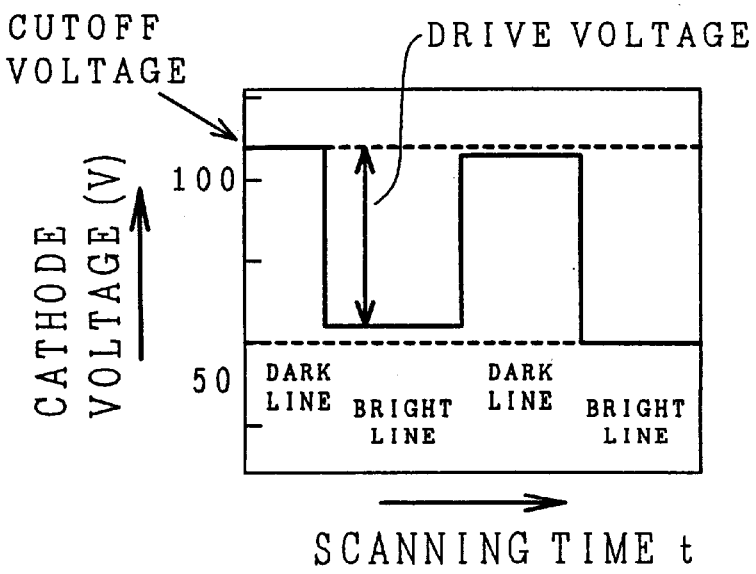
FIG. 6A, FIG. 6B and FIG. 6C are the explanation figures of the answer characteristics of the cathodic drive voltage.
Figure 6B:
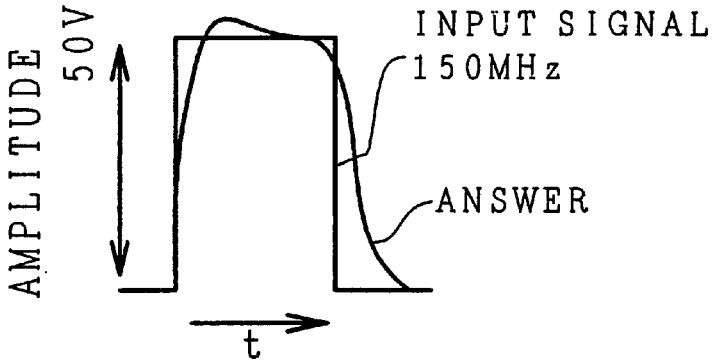
Figure 6C:
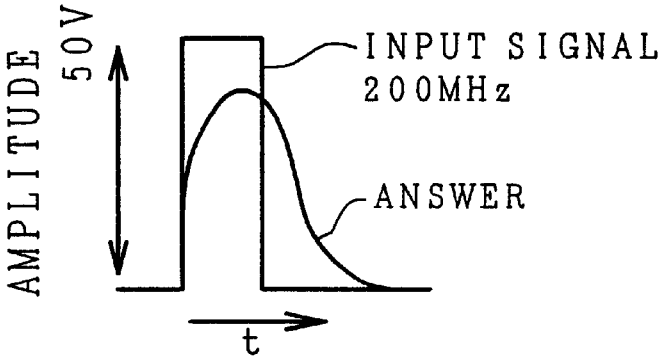

Accelerating by the positive electric potential of the second electrode 23 as it was shown in above FIG. 5, the electron beam emitted from the cathode passes the first electrode 22. And then, the electron beam focuses near the middle of the first electrode 22 and the second electrode 23 once, and thing point 28 is formed. The electron beam is supplied to the main lens that is formed to the opposed part of the third electrode 24 and the fourth electrode 25 of FIG. 4 emanating by the space electric charge effect later. And then, the electron beam receives the strong focus action through the main lens, and the spot is formed on the fluorescent body film.

This spot is projection of the thing point through the main lens. It is necessary to reduce the diameter of this thing point to make the beam spot diameter on the screen small. It is necessary to reduce the measure of the electron beam pass hole of the first electrode 22 and the circumference electrode for that. This increases the cathodic electric current density simultaneously.

As for distance C between the cathode and the first electrode 22 in FIG. 5, it is desirable that it is as near as possible. But when activating in the vacuum in the manufacturing process of the cathode-ray tube, cathode 21 is heated to almost 140 % against the stationary operation by the heater. The quantity that the cathodic structure body expands by heat at this time is anticipated, and it is necessary to separate cathode 21 to the distance that does not touch with the first electrode 22.

It was proved that it was necessary to make distance C between cathode 21 and the first electrode 22 0.1 mm at least in the state that cools down before the heater lights by the experiment.

Then, it is necessary to lower the cut-off voltage to lower the drive voltage. At this time, the method of low setting the electric potential against the first electrode 22 of the second electrode 23 has generality. But the cathodic electric current density cannot be maintained by this method, and deterioration of the beam spot diameter is caused. Therefore, it is necessary to reduce the hole diameter of the first electrode 22 and to maintain the electric current density.

Then, it is necessary to set distance B between the first electrode 22 and the second electrode 23 in FIG. 5 more than a certain quantity to dissolve the following problems.

(1) Problems such as the discharging and leakage arise by the electric potential difference of the voltage that is applied to each.

(2) The alien substance enters between electrodes.

Figure 1:
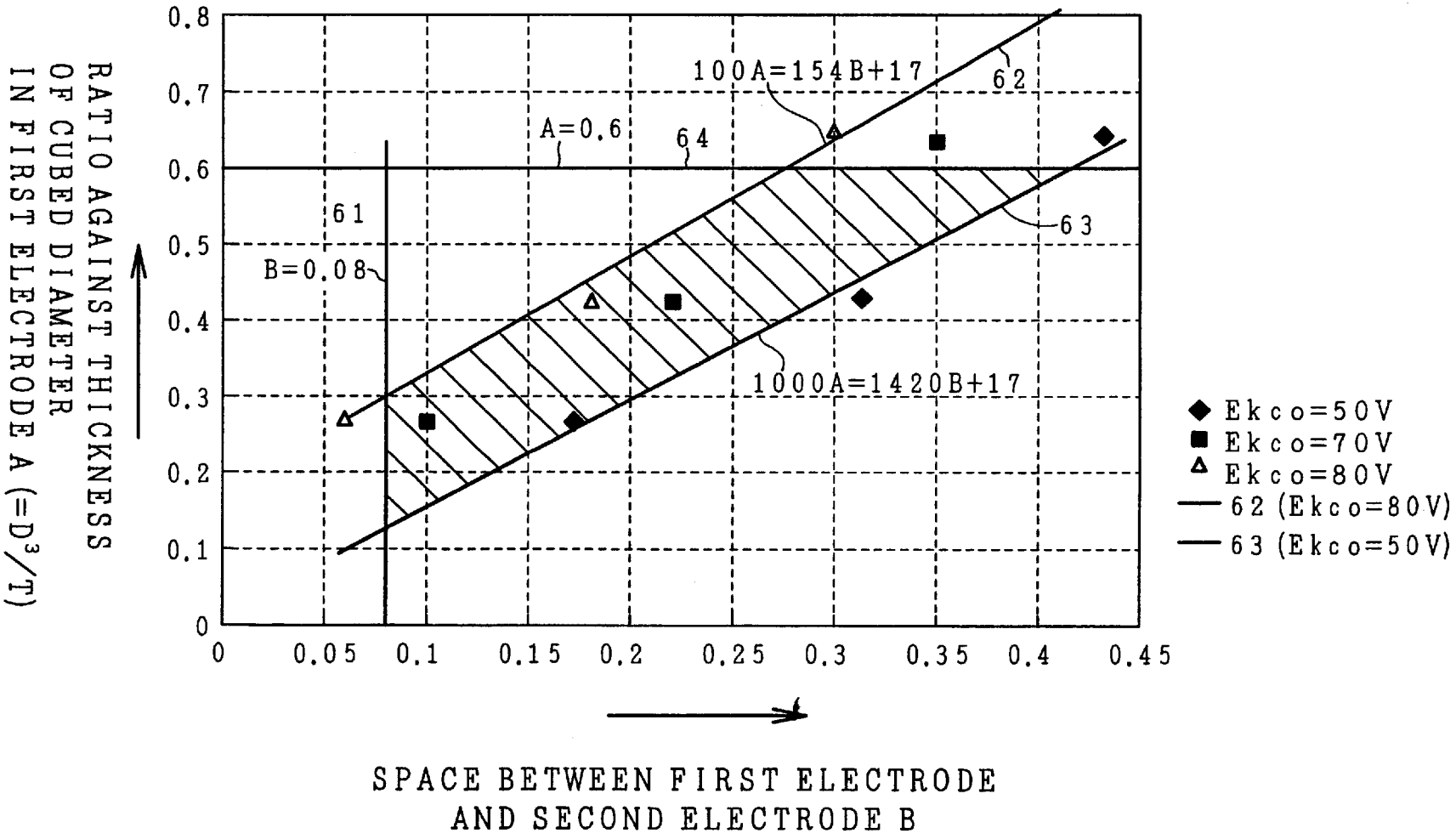
FIG. 1 is the explanation figure that illustrates relationship between the space between the first electrode and the second electrode, the diameter of the electron beam pass hole in the first electrode and the electrode thickness of sheet in the first electrode in the electron gun provided for a color cathode-ray tube according to the present invention.

FIG. 1 is the explanation figure that illustrates relationship between the space between the first electrode and the second electrode, the diameter of the electron beam pass hole in the first electrode and the electrode thickness of sheet in the first electrode in the electron gun provided for a color cathode-ray tube according to the present invention.

In the same diagram, vertical axis A is the ratio against the thickness of sheet of the electron beam pass part in the first electrode of the value that cubed the average diameter of the direction that is orthogonal with the common plane of the electron beam pass hole in the first electrode and the common plane direction. Horizontal spindle B is the space between the electron beam pass hole in the first electrode and the electron beam pass hole in the second electrode.

It is necessary to prevent the above discharging, leakage or the alien substance invasion. Therefore, it is necessary to make distance B between the first electrode 22 and the second electrode 23 larger than straight line 61 of FIG. 1 from each electrode application voltage and the experienced size of the survival alien substance in the tube. That is, it is necessary to make it $B \geqq 0.08$(mm).

On the other hand, in the color cathode-ray tube for the display monitor, the recommendation brightness of the display screen is almost 100 cd/m$^2$. At this time, each cathodic electric current of the cathode-ray tube is an about 0.3 mA. It is necessary to make the clock frequency of the drive voltage 200 MHz at least to display the high resolution image that is number 2MPixel of picture elements or more in the color cathode-ray tube for the display monitor that is the valid screen diagonal direction measure 51 cm.

In the video band of this 200 MHz or more, it is necessary to make the drive voltage almost 40 V or less to obtain the cathodic electric current an about 0.3 mA (screen brightness is almost equivalent in 100 cd/m$^2$ or more) accurately reproducing the image signal. This was proved by the experiment. Therefore, it is necessary to set the cut-off voltage to secure the necessary drive voltage at below a certain value.

Figure 2:
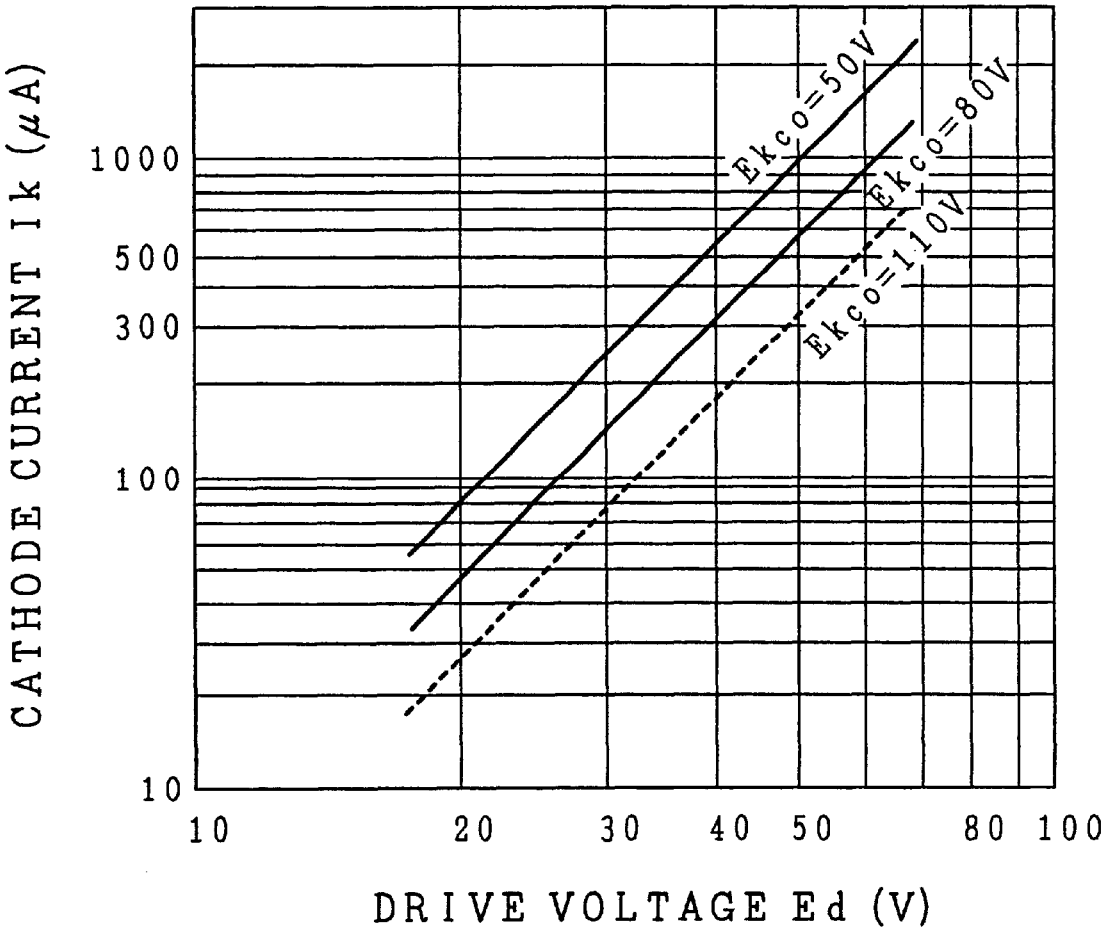
FIG. 2 is a drive characteristics diagram of the cathode-ray tube that shows relationship between drive voltage Ed and cathodic electric current Ik in the electron gun provided for the color cathode-ray tube.
Figure 3:
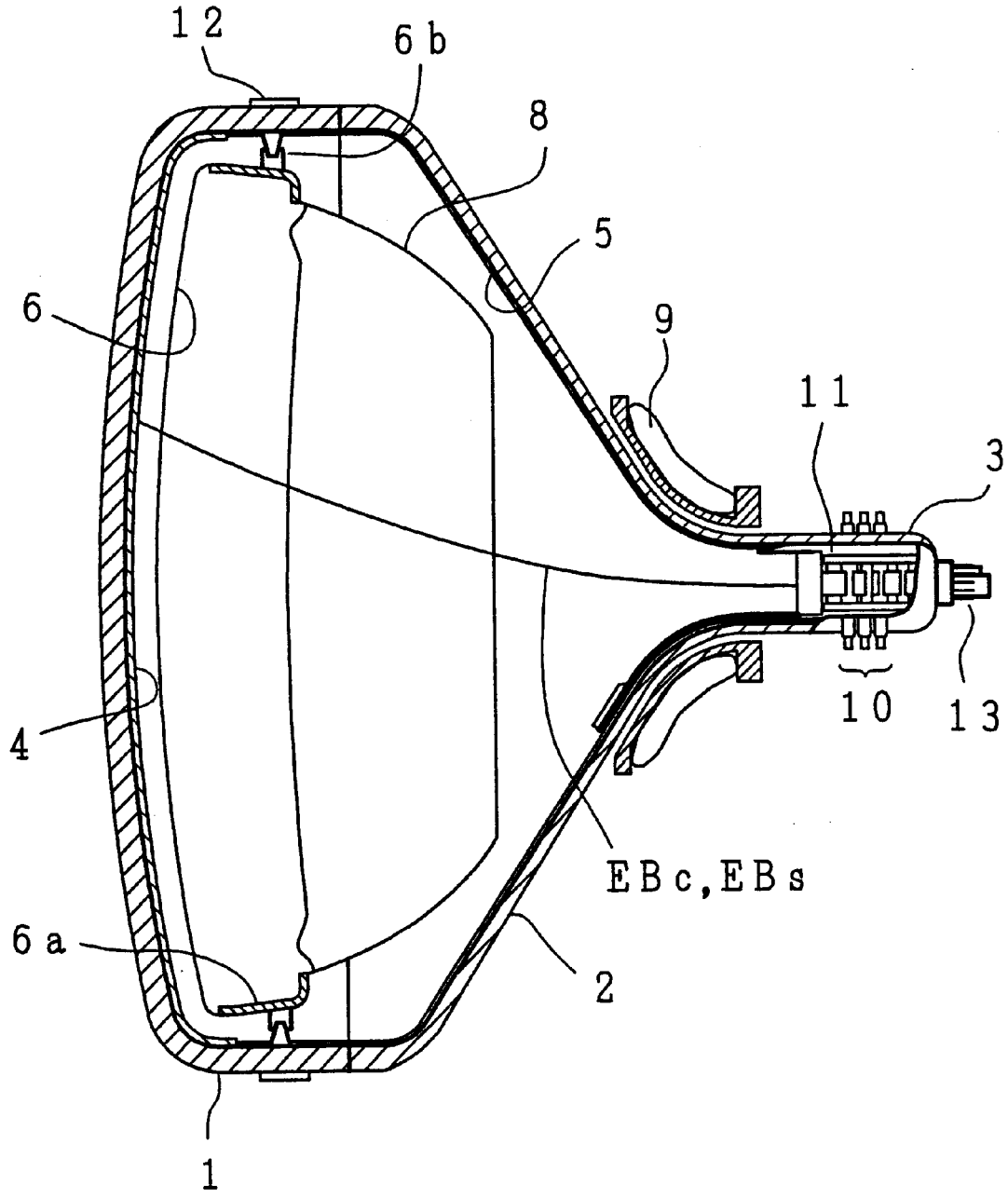
FIG. 3 is the vertical sectional view that explains the outline structure of the color cathode-ray tube.

FIG. 2 is a drive characteristics diagram of the cathode-ray tube that shows relationship between drive voltage Ed and cathodic electric current Ik of the electron gun of the color cathode-ray tube.

Cut-off voltage Ekco needs to be almost 80 V or less to make the drive voltage almost 40 V or less when obtaining almost 300 microamperes or more electric current per 1 cathode from the same diagram.

About this cut-off voltage, the following thing is known from the empirical formula of H. Moss.

(1) The cut-off voltage is proportional to the cube of the diameter of the electron beam pass hole of the first electrode.

(2) The cut-off voltage is inversely proportional to the electrode thickness of sheet of the first electrode, the distance between the cathode and the first electrode and the distance between the first electrode and the second electrode.

It must be considered that as it was mentioned above, distance C between cathode 21 and the first electrode 22 is made 0.1 mm at least.

The average diameter of the direction of the vertical and the horizontal of electron beam pass hole 22A in the first electrode 22 is made D. The electrode thickness of sheet of the electron beam pass hole part in the first electrode 22 is made T. The space between electron beam pass hole 22A in the first electrode 22 and electron beam pass hole 23A in the second electrode 23 is made B.

It is necessary to set above D, T and B to satisfy the following relation to maintain the cathodic electric current density when making cut-off voltage Ekco operate in 80 V or less.

$$A=D^3/T$$

$$100A \leqq 154B+17$$

That is, it is necessary to make ratio $A(=D^3/T)$ against electrode thickness of sheet T of the electron beam pass hole part of electron beam pass hole diameter (D) in the first electrode smaller than straight line 62 of FIG. 1. This was proved by orbit analysis of the electron beam.

And, the cut-off voltage fluctuates in almost 10 V difference from the measure precision of the parts of each cathode, the first electrode and the second electrode and the error at the time of manufacturing in those assemblies. Especially, when it fluctuates in the difference of which the cut-off voltage is larger than 20% between 3 cathodes, the load of each cathodic voltage adjustment circuit in the display monitor enlarges, the cost of the monitor hangs, and it is not practical. As for the cut-off voltage, when this is taken into consideration, it is necessary to be 50 V or more.

It is necessary to set above D, T and B to satisfy the following relation to secure this 50 V cut-off voltage Ekco.

$$A=D^3/T$$

$$1000A \geqq 1420B+17$$

That is, it is necessary to make ratio $A(=D^3/T)$ against electrode thickness of sheet T of the electron beam pass hole part of electron beam pass hole diameter (D) in the first electrode larger than straight line 63 of FIG. 1. And, straight line 63 is the relational expression of above A and B to maintain the cathodic electric current density when making cut-off voltage Ekco operate in 50 V. This was proved by orbit analysis of the electron beam.

By using these relations, the drive voltage can be reduced without making focus characteristics deteriorate maintaining the cathodic electric current density.

On the other hand, ratio A against the thickness in the relevant part of the value that cubed the average diameter of the vertical and the horizontal of electron beam pass hole 22A in the first electrode 22 is almost the function of the hole diameter of the electron beam pass hole of the electrode. That is, when the hole diameter of this electron beam pass hole enlarges, the focus characteristics are deteriorated. This is because the diameter of the thing point enlarges. By an increase of the diameter of the thing point that is projected on the fluorescent body film, the focus characteristics are deteriorated.

Therefore, as it is shown to straight line 64 of FIG. 1, to maintain focus characteristics in the color cathode-ray tube for the high resolution display monitor of which the number of picture elements is 2MPixel or more, it must be $A \leqq 0.6$. This is because it is necessary to make average diameter D of the vertical and the horizontal of electron beam pass hole 22A in the first electrode 22 smaller than 0.4 mm to enable the high resolution image display of which in the color cathode-ray tube for the display monitor, the number of picture elements is 2MPixel or more. And, it is necessary to set electrode thickness of sheet T of the electron beam pass hole part at the range of 0.06–0.13 MM to high precisely form electron beam pass hole 22A in the above first electrode 22. And, it is desirable that when the mechanical intensity of the first electrode 22 itself is considered, electrode thickness of sheet T is almost made 0.1 mm. And then, being accompanied to small set diameter D of electron beam pass hole 22A, electrode thickness of sheet T has only to be thinned gradually.

Reducing the cut-off voltage, by setting the value of above A and B in the area that is surrounded by the all above relational expressions (range that is shown in the slanting line in FIG. 1), focus characteristics can be maintained. The reduction effect of the beam spot diameter can be achieved by the hole diameter reduction of the electron beam pass hole in the first electrode 22.

The amplitude of the drive voltage can be lowered without making the beam spot diameter deteriorate from the former state because the drive voltage can be reduced simultaneously.

As a result in the high deflection frequency (that is, high video band) that is considered as the difficulty of usual, the highly bright and high resolution image can be obtained easily, and the input signal to the cathode can be reproduced on the screen accurately.

The structure figure of the electron gun shown in above FIG. 4 and FIG. 5 is referred to, and the example of performing this invention is explained.

Heater 20 is given 5–10 V electric potential difference as a heater voltage. The cathodic electric potential that is the image signal is applied to cathode 21. 0~−200 V are applied to the first electrode 22 as a control electrode electric potential. 400~1000 V are applied to the second electrode 23 as an acceleration electrode electric potential. And, 5–10 kV is applied to the third electrode 24 as a focusing electrode electric potential. 20–35 kV is applied to the fourth electrode 25 as an anode electric potential.

In this execution example, it is as follows set.

(1) Hole diameter D of electron beam pass hole 22A in the first electrode 22 is 0.30 mm.

(2) Electrode thickness of sheet T of the relevant electron beam pass hole part is 0.1 mm.

(3) The applied electric potential to the first electrode 22 is 0 V. Therefore, the value of $A(=D^3/T)$ is 0.27. In addition, it is as follows set.

(4) The hole diameter of electron beam pass hole 23A in the second electrode 23 is 0.37 mm.

(5) The applied electric potential to the second electrode 23 is 600 V.

(6) Distance B between the electron beam pass hole part in the first electrode 22 and the electron beam pass hole part in the second electrode 23 is 0.12 mm. Therefore, there are the A value and the B value in the area that is surrounded by above 4 relational expressions.

At this time, the cut-off voltage of cathode 21 becomes 70 V. In case the cathodic electric current quantity is 0.3 mA about each cathode, the drive voltage that is necessary in 70 V cut-off voltage is 40 V or less. Therefore, deterioration is not regarded as vertical line brightness by video frequency 200 MHz or more, and the beam spot diameter is not seen to deteriorate, either.

And, the shape of electron beam pass hole 22A in the first electrode 22 does not need to be a true circle. According to the necessary characteristics of the cathode-ray tube, electron beam pass hole 22A in the first electrode 22 can be changed to the various shapes such as the vertically long shape, the oblong shape, the rectangle and the ellipse.

The hole diameter of the electron beam pass hole that is used for the $A(=D^3/T)$ value in this execution example is defined with the average diameter of the diameter of each vertical direction and horizontal direction. And, this invention is not limited to the color cathode-ray tube with the electron gun in the form shown to the above execution example. This invention also can be likewise applied to various cathode-ray tubes with the electron gun that has other electrode structure (for example, multiple focusing lens structure).

As it is above explained, the color cathode-ray tube of the present invention provides the electron gun of the in-line type with the electron beam generation means of having the cathode, the first electrode and the second electrode. And then, the color cathode-ray tube of the present invention is setting relationship between the ratio against the electrode thickness of sheet in the first electrode of the value that cubed the electron beam pass hole diameter in the first electrode and the distance between the electron beam pass hole part in the first electrode and the electron beam pass hole part in the second electrode.

According to the color cathode-ray tube of the present invention, the drive voltage can be reduced. Therefore, even if it is the high resolution screen display with the high deflection frequency, the answer against the input signal is not deteriorated, and deterioration of focus characteristics does not arise, either.

What is claimed is:

1. A Color cathode-ray tube that provides a fluorescent face, a shadow mask and an electron gun, comprising:

the fluorescent face having a fluorescent body film that fluorescent body picture elements of 3 colors was arranged the shadow mask being a color selection electrode that stood and installed close to the fluorescent face, the electron gun having means of generating 3 electron beams and means of forming a main lens, the means of generating the electron beams containing cathodes, a first electrode and a second electrode to discharge the 3 electron beams at parallel in a common plane in a direction of the fluorescent face, the means of forming the main lens containing several electrodes that make the 3 electron beams focus in the fluorescent face, wherein an average diameter of directions of vertical and horizontal of an electron beam pass hole in the first electrode is made D(mm), an electrode thickness of sheet of the electron beam pass part in the first electrode is made T(mm), a space between the electron beam pass hole in the first electrode and the electron beam pass hole in the second electrode is made B(mm), and the D, T and B are set in an area that is surrounded in 4 straight lines that are expressed in the following relation.

(A is made $D^3/T$ here)

$$100A=154B+17$$

$$1000A=1420B+17$$

$$A=0.6$$

$$B=0.08.$$

2. A color cathode-ray tube according to claim 1, wherein the number of the fluorescent body picture elements in the fluorescent face is 2MPixel or more.

3. A color cathode-ray tube according to claim 1, wherein the frequency of the drive voltage that is applied to the cathode is 200 MHz or more.

4. A color cathode-ray tube according to claim 1, wherein the drive voltage that is applied to the cathode is 40 V or less.

5. A color cathode-ray tube according to claim 1, wherein the brightness of the fluorescent face is 100 $cd/mm^2$ or more.

6. A color cathode-ray tube according to claim 1, wherein the cathodic electric current is 0.3 mA or more.

7. A color cathode-ray tube according to claim 1, wherein the cut-off voltage of the cathode is 80 V or less.

8. A color cathode-ray tube according to claim 1, wherein D is smaller than 0.4 mm.

9. A color cathode-ray tube according to claim 8, wherein T is the range of 0.06–0.13 mm.

10. A color cathode-ray tube according to claim 1, wherein the distance between the cathode and the first electrode is 0.1 mm or more.

11. A color cathode-ray tube that provides a fluorescent face, a shadow mask and an electron gun, comprising:

the fluorescent face having a fluorescent body film that fluorescent body picture elements of 3 colors was arranged, the shadow mask being a color selection electrode that stood and installed close to the fluorescent face, the electron gun having means of generating 3 electron beams and means of forming a main lens, the means of generating the electron beams containing cathodes, a first electrode and a second electrode to discharge the 3 electron beams at parallel in a common plane in a direction of the fluorescent face, the means of forming the main lens containing several electrodes that make the 3 electron beams focus in the fluorescent face, wherein an electric potential that is applied to the second electrode is 400~1000 V, a cut-off voltage of the cathode is 80 V or less, an average diameter of directions of vertical and horizontal of an electron beam pass hole in the first electrode is made D(mm), an electrode thickness of sheet of the electron beam pass part in the first electrode is made T(mm), a space between the electron beam pass hole in the first electrode and the electron beam pass hole in the second electrode is made B(mm), and the D, T and B are set to satisfy the following relation.

$$A=D^3/T$$

$$100A \leqq 154B+17$$

12. A color cathode-ray tube according to claim 11, wherein the number of the fluorescent body picture elements in the fluorescent face is 2MPixel or more.

13. A color cathode-ray tube according to claim 11, wherein the frequency of the drive voltage that is applied to the cathode is 200 MHz or more.

14. A color cathode-ray tube according to claim 11, wherein the drive voltage that is applied to the cathode is 40 V or less.

15. A color cathode-ray tube according to claim 11, wherein the brightness of the fluorescent face is 100 $cd/mm^2$ or more.

16. A color cathode-ray tube according to claim 11, wherein the cathodic electric current is 0.3 mA or more.

17. A color cathode-ray tube according to claim 11, wherein it is the $A \leqq 0.6$.

18. A color cathode-ray tube according to claim 17, wherein D is smaller than 0.4 mm.

19. A color cathode-ray tube according to claim 18, wherein T is the range of 0.06–0.13 mm.

20. A color cathode-ray tube according to claim 11, wherein the distance between the cathode and the first electrode is 0.1 mm or more.

21. A color cathode-ray tube according to claim 11, wherein the cut-off voltage of the cathode is 50 V or more.

22. A color cathode-ray tube according to claim 21, wherein the D, T and B are set to satisfy the following relation.

$$A=D^3/T$$

$$1000A \geqq 1420B+17$$

23. A color cathode-ray tube according to claim 11, wherein it is the $B \geqq 0.08$ mm.

* * * * *